US011071393B2

(12) United States Patent
Ribble et al.

(10) Patent No.: US 11,071,393 B2
(45) Date of Patent: Jul. 27, 2021

(54) APPARATUS FOR ADDING HOSPITAL BED FUNCTIONALITY TO AN AT-HOME BED

(71) Applicant: Hill-Rom Services, Inc., Batesville, IN (US)

(72) Inventors: David L. Ribble, Batesville, IN (US); Thomas F. Heil, Batesville, IN (US); Brian L. Lawrence, Cincinnati, OH (US); Kirsten M. Emmons, Batesville, IN (US); Craig M. Meyerson, Syracuse, NY (US)

(73) Assignee: Hill-Rom Services, Inc., Batesville, IN (US)

( * ) Notice: Subject to any disclaimer, the term of this patent is extended or adjusted under 35 U.S.C. 154(b) by 364 days.

(21) Appl. No.: 16/149,306

(22) Filed: Oct. 2, 2018

(65) Prior Publication Data

US 2019/0099007 A1 Apr. 4, 2019

Related U.S. Application Data

(60) Provisional application No. 62/567,995, filed on Oct. 4, 2017.

(51) Int. Cl.

| | |
|---|---|
| ***A47C 20/04*** | (2006.01) |
| ***A61G 7/015*** | (2006.01) |
| ***A61G 7/05*** | (2006.01) |
| ***A47C 20/08*** | (2006.01) |
| ***A47C 21/08*** | (2006.01) |

(Continued)

(52) U.S. Cl.

CPC ..... *A47C 20/048* (2013.01); *A47C 20/08* (2013.01); *A47C 21/08* (2013.01); *A61G 7/015* (2013.01); *A61G 7/0509* (2016.11); *A61G 7/0524* (2016.11); *A61G 7/07* (2013.01); *A61G 7/0755* (2013.01); *A61G 2203/20* (2013.01); *A61G 2203/36* (2013.01)

(58) Field of Classification Search

CPC ..... A47C 20/048; A47C 20/08; A47C 21/08; A61G 7/0524; A61G 7/0509; A61G 7/015; A61G 7/07; A61G 7/0755; A61G 2203/20; A61G 2203/36

See application file for complete search history.

(56) References Cited

U.S. PATENT DOCUMENTS

| | | | |
|---|---|---|---|
| 1,772,310 | A | 8/1930 | Hart |
| 2,769,182 | A | 11/1956 | Nunlist |
| 3,161,219 | A | 12/1964 | Danhi |

(Continued)

FOREIGN PATENT DOCUMENTS

| | | | |
|---|---|---|---|
| GB | 1474018 | A | 5/1977 |
| GB | 2177906 | A | 2/1987 |

(Continued)

OTHER PUBLICATIONS

European Search Report for European Patent Application No. EP18198481, dated Feb. 5, 2019, 6 pages.

*Primary Examiner* — David R Hare
*Assistant Examiner* — Adam C Ortiz
(74) *Attorney, Agent, or Firm* — Barnes & Thornburg LLP

(57) ABSTRACT

The present disclosure is related to a bed assembly. Specifically, the present disclosure relates to a bed assembly that is compatible with a traditional consumer bed and can enhance the traditional consumer bed so it provides features of a traditional hospital bed.

21 Claims, 7 Drawing Sheets

(51) Int. Cl.
*A61G 7/075* (2006.01)
*A61G 7/07* (2006.01)

(56) References Cited

U.S. PATENT DOCUMENTS 3,392,412 A 7/1968 Robert
3,426,373 A 2/1969 Scott et al.
3,492,988 A 2/1970 Mare
3,606,623 A 9/1971 Robert et al.
3,667,075 A 6/1972 Ballard
3,781,928 A 1/1974 Swallert
4,142,263 A 3/1979 Pierson
4,287,620 A 9/1981 Zur
4,309,783 A 1/1982 Cammack et al.
4,488,322 A * 12/1984 Hunt ..... A47C 20/048 5/713
4,525,885 A 7/1985 Hunt et al.
4,527,298 A 7/1985 Moulton
4,559,655 A 12/1985 Peck
4,628,557 A 12/1986 Murphy
4,686,722 A 8/1987 Swart
4,745,647 A 5/1988 Goodwin
4,751,754 A 6/1988 Bailey et al.
4,768,249 A 9/1988 Goodwin
4,798,227 A 1/1989 Goodwin
4,807,313 A * 2/1989 Ryder ..... A47C 19/045 5/610
4,839,932 A 6/1989 Williamson
4,873,731 A 10/1989 Williamson
4,873,737 A 10/1989 Savenije
4,896,389 A 1/1990 Chamberland
4,934,002 A 6/1990 Watanabe
4,935,968 A 6/1990 Hunt et al.
4,941,221 A 7/1990 Kanzler
4,947,493 A * 8/1990 Salonica ..... A61G 7/1007 4/456
4,949,413 A 8/1990 Goodwin
4,949,414 A 8/1990 Thomas et al.
4,977,629 A 12/1990 Jones
5,095,568 A 3/1992 Thomas et al.
5,103,519 A 4/1992 Hasty
5,170,522 A 12/1992 Walker
5,251,349 A 10/1993 Thomas et al.
5,267,363 A 12/1993 Chaffee
5,279,010 A 1/1994 Ferrand et al.
5,325,551 A 7/1994 Tappel et al.
5,331,698 A 7/1994 Newkirk et al.
5,367,728 A 11/1994 Chang
5,375,910 A 12/1994 Murphy
5,491,854 A 2/1996 Music
5,575,026 A 11/1996 Way et al.
5,577,278 A 11/1996 Barker et al.
6,012,186 A 1/2000 Soltani et al.
6,311,348 B1 11/2001 Luff et al.
6,681,425 B2 1/2004 Leventhal et al.
6,715,172 B2 4/2004 Leventhal et al.
2001/0047549 A1 12/2001 Ulert et al.
2011/0214234 A1* 9/2011 Herman ..... A61G 7/0524 5/600
2014/0245539 A1 9/2014 Ooba
2015/0282630 A1* 10/2015 McIntyre ..... A47C 21/06 5/660
2017/0143565 A1* 5/2017 Childs ..... A61G 7/012
2018/0360681 A1* 12/2018 Paul ..... A61G 7/015

FOREIGN PATENT DOCUMENTS

WO 8809140 A1 12/1988
WO 9848673 A1 11/1998
WO WO-0170167 A2 * 9/2001 ..... A61G 7/00

* cited by examiner

APPARATUS FOR ADDING HOSPITAL BED FUNCTIONALITY TO AN AT-HOME BED

PRIORITY CLAIM

This application claims priority under 35 U.S.C. § 119(e) to U.S. Provisional Application No. 62/567,995, filed Oct. 4, 2017, which are expressly incorporated by reference herein.

TECHNICAL FIELD

The present disclosure relates to a bed assembly for use during at-home care. More specifically, the present disclosure relates to a bed assembly that elevates the head section and foot section of the traditional consumer mattress and monitors occupants lying on the mattress.

BACKGROUND

The present disclosure is related to a bed assembly. Specifically, the present disclosure relates to a bed assembly that is compatible with a traditional consumer bed and can enhance the traditional consumer bed so it provides features of a traditional hospital bed. Such features include the ability to elevate the head section and foot section of the traditional consumer mattress using inflatable air bladders, contactless sensing of the occupant, and a siderail with integrated point-of-care monitoring.

Extended hospitalization of a patient is an ongoing challenge due to the high cost incurred by the patient and the hospital. At-home care is also challenging due to the high cost, difficulty, and complexity of equipping the home for patient care. While several systems and methods exist for equipping the home for patient care, opportunity exists for continued development in this area.

Still further, a need exists for an assembly for at-home use capable of providing a caregiver, such as a nurse, information regarding vital signs of a patient without requiring the caregiver to disturb the patient.

SUMMARY

The present disclosure includes one or more of the features recited in the appended claims and/or the following features which, alone or in any combination, may comprise patentable subject matter.

According to a first aspect of the present disclosure, a bed assembly comprises a frame, a first baseplate, a mattress, a first accordion sleeve, a first inflatable air bladder, a first moveable top plate, and an air source. The first baseplate is configured to be supported by the frame. The first baseplate has a free end and a pivoting end. The mattress is configured to be supported by the first baseplate. The mattress has at least one moveable free end. The first inflatable air bladder is within the first accordion sleeve and is independent of the first baseplate. The first moveable top plate is secured to the first accordion sleeve. The first moveable top plate is positionable to underlie the at least one moveable free end of the mattress. The first moveable top plate has a free end and a pivoting end. The pivoting end of the first moveable top plate is pivotally connected to the pivoting end of the first baseplate. The air source is in fluid communication with the first air bladder and is operable to selectively inflate the first inflatable air bladder to move the first moveable top plate relative to the first baseplate and, thereby, create space between the mattress and the first baseplate.

According to a second aspect of the present disclosure, a bed assembly comprises a first accordion sleeve, a first baseplate, a first inflatable air bladder, a first moveable top plate, and an air source. The first inflatable air bladder is within the first accordion sleeve and is independent of the first baseplate. The first moveable top plate is secured to the first accordion sleeve and positionable to underlie a mattress. The first moveable top plate has a free end and a pivoting end. The pivoting end of the first moveable top plate is pivotally connected to the pivoting end of the first baseplate. The air source is in fluid communication with the first inflatable air bladder and operable to selectively inflate the first air bladder to move the first moveable top plate relative to the first baseplate and, thereby, create space between the mattress and the first baseplate.

In some embodiments, the bed assembly further comprises at least one first strap. The first strap is secured to the first inflatable air bladder and a retainer. The retainer is secured to the first baseplate and is configured to engage with the mattress to thereby prevent movement of the mattress relative to the bed assembly.

In some embodiments, the bed assembly further comprises at least one second strap. The second strap is secured to the first inflatable bladder. The at least one second strap is configured to engage with the frame to thereby prevent movement of the mattress relative to the bed assembly.

In some embodiments, the bed assembly further comprises a collapsible siderail that is pivotally secured to the moveable top plate.

In some embodiments, the bed assembly further comprises a telemedicine screen that is pivotally attached to the collapsible siderail.

In some embodiments, the collapsible siderail further comprises a control system, an audio or communication system, an integrated point-of-care monitoring system, or a wireless hub.

In some embodiments, the collapsible siderail is further configured to emit light.

In some embodiments, the bed assembly further comprises a second inflatable air bladder configured to be secured to the mattress and in fluid communication with the air source.

In some embodiments, the bed assembly further comprises a second baseplate, a second accordion sleeve, and a second moveable top plate. The second baseplate has a free end and pivoting end and is independent of the second inflatable air bladder. The second accordion sleeve encompasses the second inflatable air bladder. The second moveable top plate is secured to the second accordion sleeve and positionable to underlie the mattress. The second moveable top plate having a free end and a pivoting end, the pivoting end of the second moveable top plate pivotally connected to the pivoting end of the second baseplate.

In some embodiments, the bed assembly further comprises at least one third strap secured to the second inflatable air bladder and the retainer. The retainer is secured to the baseplate and engaged with the mattress to thereby prevent movement of the mattress relative to the bed assembly.

In some embodiments, the at least one third strap further comprises a set of pre-defined connection points based on the occupant's height.

In some embodiments, the second inflatable bladder is configured to be tethered to the first inflatable bladder for at least indicating correct positioning based on the occupant's height.

In some embodiments, the bed assembly further comprises a contactless sensing system. The contactless sensing system is secured under the mattress.

In some embodiments, the bed assembly further comprises an accelerometer in the first inflatable bladder.

According to a third aspect of the present disclosure, a bed assembly comprises a means independent of the mattress and a mattress foundation. An articulated frame retainer is operable for retaining the mattress in a normal relationship with the mattress foundation as the moveable top plate moves.

Additional features, which alone or in combination with any other feature(s), such as those listed above and/or those listed in the claims, can comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
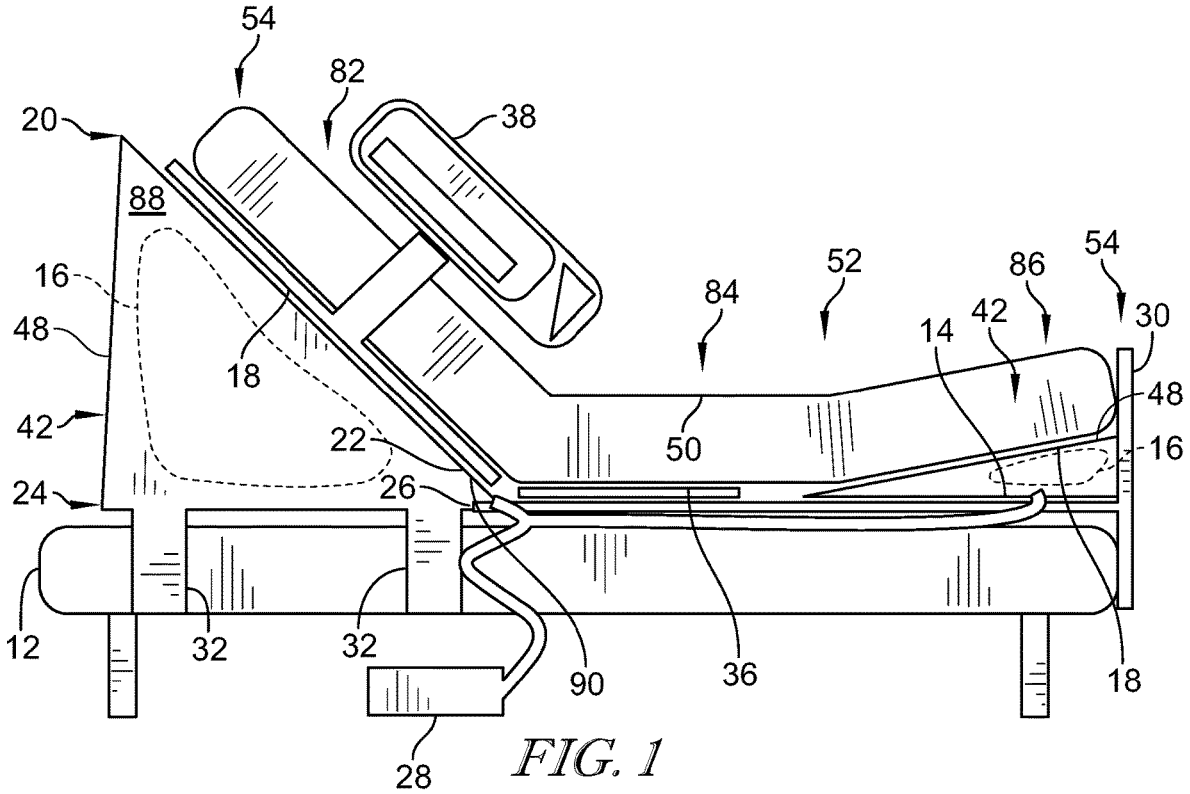
FIG. 1 is a perspective view of a bed assembly that includes a bed frame and a mattress supported on the bed frame.

An illustrative bed assembly 10 is shown in FIG. 1. A bed assembly 10 of FIG. 1 has a frame 12 which supports an elevation assembly 42 which includes a baseplate 14 which includes a free end 24 and a pivoting end 26. The baseplate 14 is configured to be supported by the frame 12. The baseplate 14 is further configured to support a mattress 50. The mattress 50 defines a patient support surface 52 which includes a head section 82, a seat section 84, and a foot section 86. The mattress 50 further includes a moveable free end 54. The moveable free end 54 may be positioned at the head section 82 of the mattress 50, the foot section 86 of the mattress, or both the head section 82 of the mattress 50 and the foot section 86 of the mattress 50.

Figure 2:
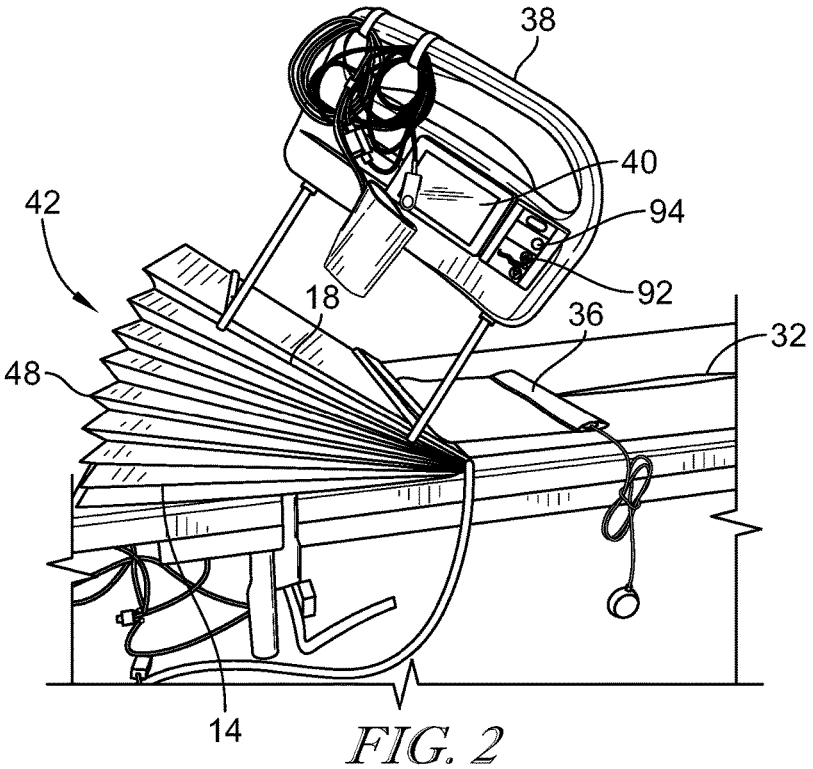
FIG. 2 is a perspective view of the bed assembly of FIG. 1 with the mattress removed.
Figure 3:
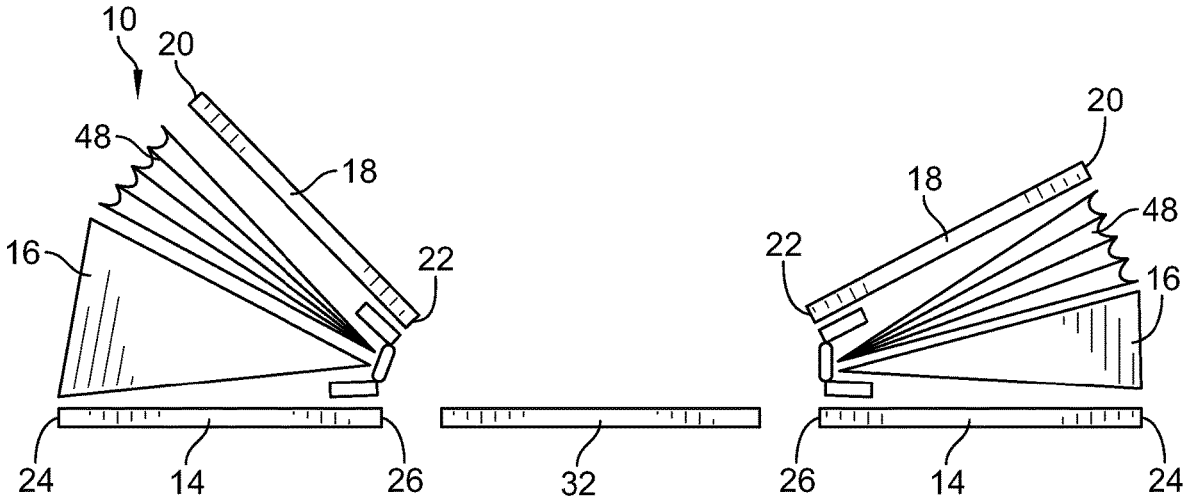
FIG. 3 is an exploded assembly view of the major components of the bed assembly of FIG. 1.

As illustrated in FIGS. 1, 2, and 3, the elevation assembly 42 further includes an accordion sleeve 48 containing a inflatable air bladder 16. The structure of the elevation assembly may be embodied similarly to the z-plate assemblies 2044 and 2064 shown in PCT Publication No. WO2016/196403, titled "Patient Support Apparatus." Similarly, the bladder 16 may be embodied similarly to the turn bladder assemblies 2034 and 2036 shown in the PCT Publication No. WO2016/196403, titled "Patient Support Apparatus." The PCT Publication No. WO2016/196403, titled "Patient Support Apparatus" is incorporated by reference herein for the disclosure of a structure suitable to lift portions of a mattress. The bed assembly 10 further includes a moveable top plate 18 secured to the accordion sleeve 48. The moveable top plate 18 is positionable to underlie the moveable free end 54 of the mattress 50. The moveable top plate 18 includes a free end 20 and a pivoting end 22. The pivoting end 22 is pivotally connected to the pivoting end 26 of the baseplate 14. The inflatable air bladder 16 within the accordion sleeve 48 is independent of the baseplate 14 and is in fluid communication with the air source 28 and a power supply 44. The air source 28 is operable to selectively inflate the inflatable air bladder 16 to move the moveable top plate 18 relative to the baseplate 14, thereby creating space 88 between the mattress 50 and the baseplate 14. The angle 90 of this space 88 may be physically limited or limited by software. Some embodiments may include a sensor 66 to measure the angle 90.

Figure 4:
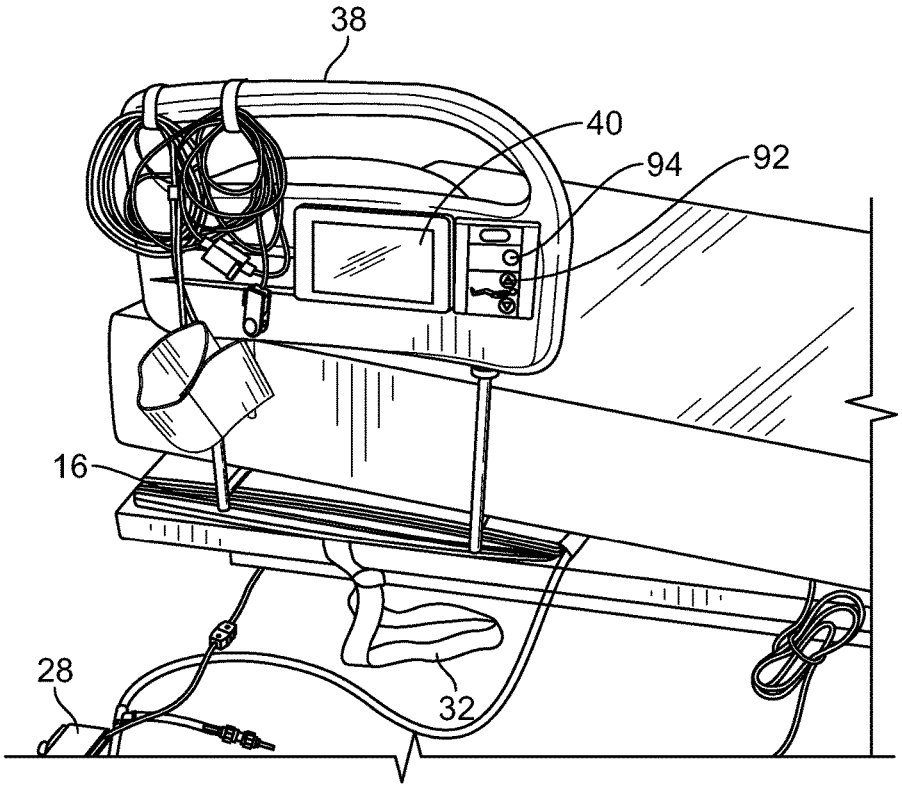
FIG. 4 is a perspective view of the exterior of the siderail of the bed assembly of FIG. 1.
Figure 7:
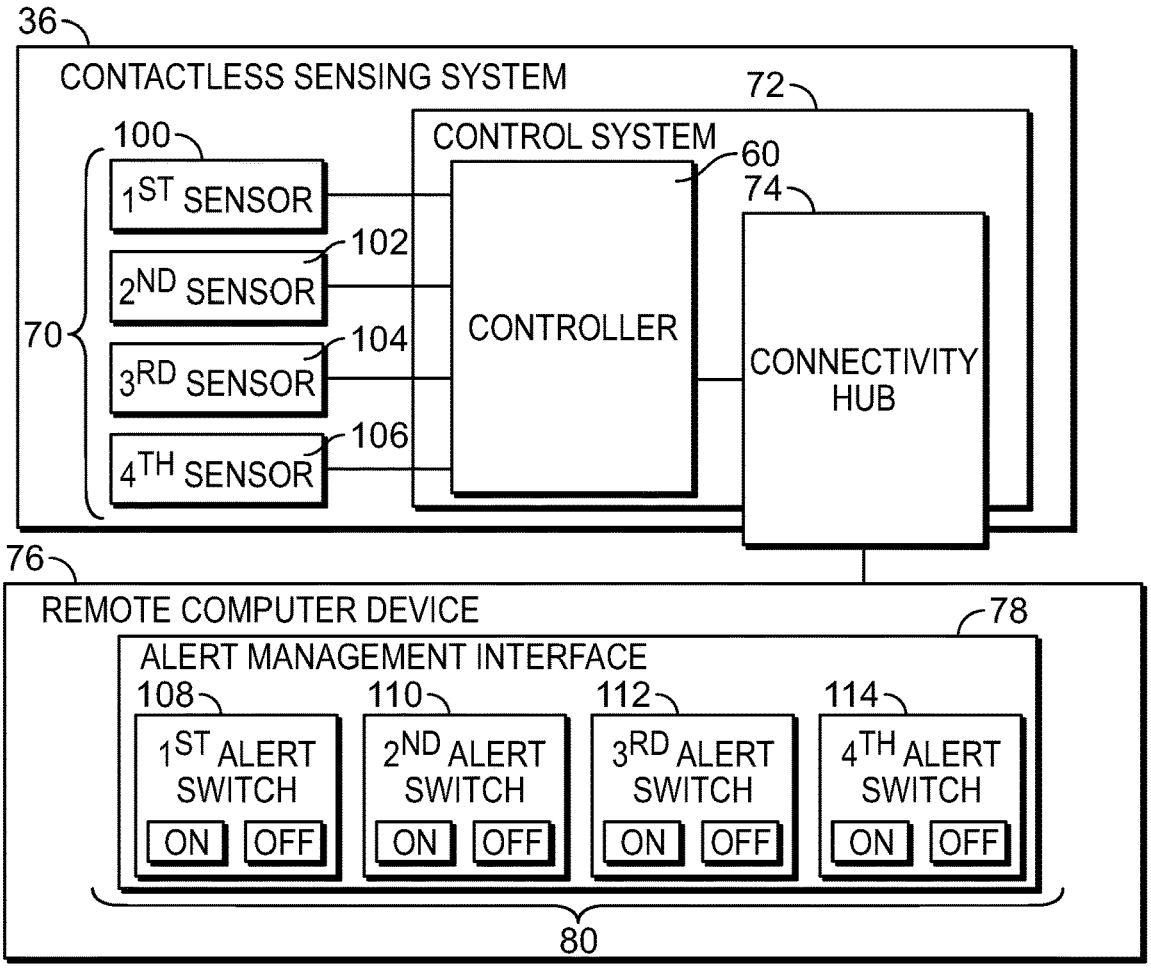
FIG. 7 is block diagram of the contactless sensing system of the bed assembly of FIG. 1.

The bed assembly 10 also includes a collapsible siderail 38 pivotally secured to the moveable top plate 18. The collapsible siderail 38 is vertically adjustable to accommodate varying surface heights from 8 inches to 12 inches and can be placed on the left side, right side, or both sides of any bed. The collapsible siderail 38 is strong enough to be used as a support for bed exit or entry. The collapsible siderail 38 is configured to further include a telemedicine screen pivotally attached to the collapsible siderail 38 and a user interface 40 including a control system 92 for vertical movement of the bed assembly 10 and internet connection, an audio or communication system 94, or a wireless connectivity hub 74, as shown in FIGS. 4, 5, and 7.

Figure 5:
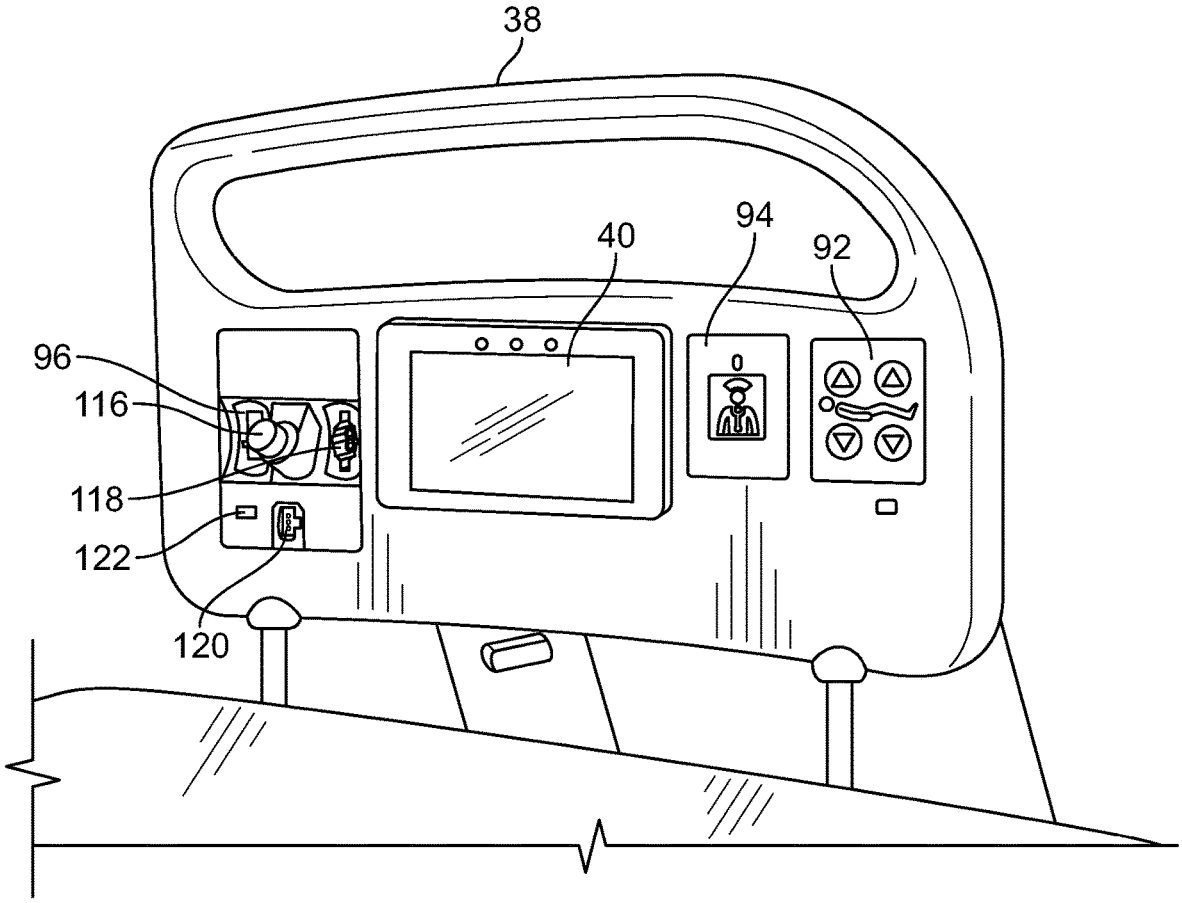
FIG. 5 is a perspective view of the interior of the siderail of the bed assembly of FIG. 1.

As shown in FIG. 5, the collapsible siderail 38 further includes an electrical connector 96 (e.g. Ethernet connector), a pneumatic port 116 (e.g. blood pressure cuff port), an electrical port 118 (e.g. power port), an electrical port 120 (e.g. 9-pin serial port), and a USB port 122.

In another embodiment, the collapsible siderail 38 further includes an integrated point-of-care monitoring system. The control system 92 is configured to connect to the internet via the connectivity hub 74, whereby, the control system 92 is configured to send data from the integrated point-of-care monitoring system and the contactless sensing system 36 to a healthcare provider.

In another embodiment, the bed assembly 10 is configured to wirelessly integrate an external device communicating with the bed assembly 10 connectivity hub 74. The bed assembly 10 is configured to track occupant use of necessary therapy or integrate therapy controls into the bed assembly 10. In this embodiment, the bed assembly 10 is configured to delivery therapy to an occupant. The bed assembly 10 is also configured to comply with the delivery of therapy.

In another embodiment, the bed assembly 10 is configured to replicate the contents of the user interface 40 and the control system 92 on a wireless device. This wireless device is configured to be used by a healthcare professional or caretaker.

In another embodiment, the bed assembly 10 is configured to pair with auxiliary devices (e.g. scale) and collect data which is displayed locally. The bed assembly 10 is further configured to replicate the contents of the user interface 40 and the control system 92 remotely as part of a system used by healthcare professionals to manage patient care and record patient data for future use.

The user interface 40 allows the user to raise and lower the moveable free end 54 of the mattress 50, control bed exit reminders and alerts, and control other environmental factors. The audio and communication system 94 of the collapsible siderail 38 is configured to allow a nurse or caregiver to call to other caregivers, such as a local alert, text to a family member, or contacting emergency services. The collapsible siderail 38 is further configured to be a wireless receiver and have internet connectivity. The collapsible siderail 38 is further configured to charge USB devices.

Figure 6:
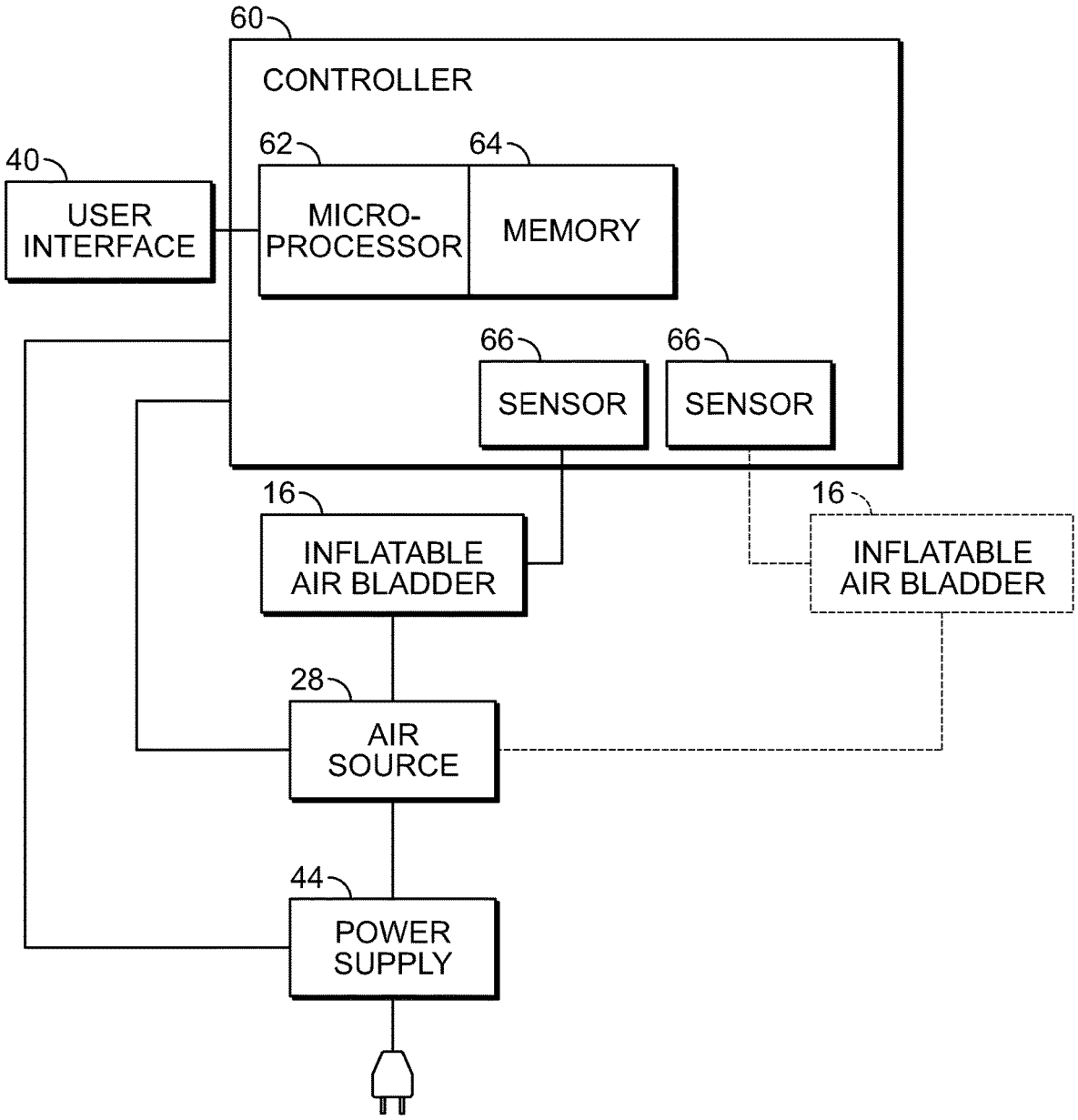
FIG. 6 is a block diagram of a portion of the electrical system of the bed assembly of FIG. 1.

As shown in FIG. 6, the controller 60 includes a microprocessor 62 coupled to a memory 64 and a sensor 66. The controller 60 is further connected to the air source 28 and the power supply 44. The microprocessor 62 is in communication with the user interface 40 and the microprocessor 62 is responsive to a user selection on the user interface 40. Once a user makes a selection on the user interface 40, the controller 60 responds to raise or lower the moveable free end 54 of the mattress 50 by communicating with the air source 28 to inflate the inflatable air bladder 16. The sensor 66 within the controller 60 is also in communication with the inflatable air bladder 16 and the inflatable air bladder 16 can be automatically inflated or deflated based on predetermined parameters once the sensor 66 exceeds a predetermined threshold.

Referring to FIGS. 2 and 3, the bed assembly 10 includes a strap 32 secured to the inflatable air bladder 16 within the accordion sleeve 48 and the retainer 30. The strap 32, thereby, holds the bed assembly 10 in place when the inflatable air bladder 16 is selectively inflated and the moveable free end 54 of the mattress 50 moves. The strap 32 may also be tightened using a cinching strap.

Referring again to FIGS. 1 and 4, the bed assembly 10 includes a strap 32 secured to the inflatable air bladder 16 within the accordion sleeve 48. The strap 32 is configured to engage the baseplate 14. The strap 32, thereby, holds the bed assembly 10 in place when the inflatable air bladder 16 is selectively inflated and the moveable free end 54 of the mattress 50 moves.

Figure 8:
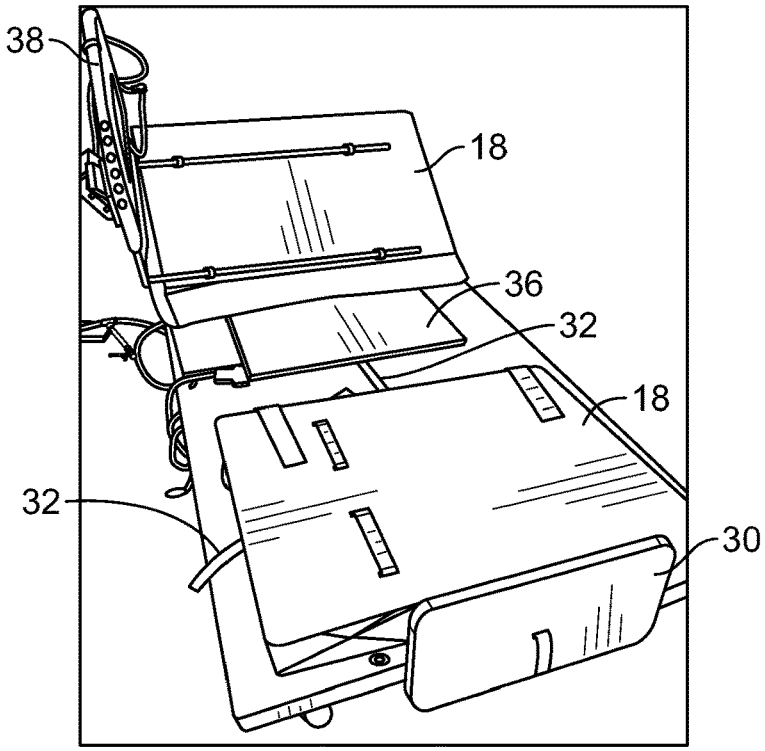
FIG. 8 is a front perspective view of the bed assembly of FIG. 1 with the mattress removed.

As shown in FIGS. 1, 3, and 8, the bed assembly 10 may include an inflatable air bladder 16 illustratively positioned at the foot section 86 of the mattress 50 that is in fluid communication with the air source 28 and configured to be secured to the mattress 50. The inflatable air bladder 26 is attached to a strap 32, and the strap 32 is secured to the retainer 30. The retainer 30 is secured to the baseplate 14 and engaged with the mattress 50, thereby preventing movement of the mattress 50 relative to the bed assembly 10.

Referring to FIG. 3, an inflatable air bladder 16 illustratively positioned at the foot section 86 of the mattress 50 may be within an accordion sleeve 48 positioned at the foot section 86 of the mattress 50. The inflatable air bladder 26 is independent of the baseplate 14. The inflatable air bladder 16 is in fluid communication with the air source 28 and the power supply 44. The baseplate 14 includes a free end 24 and a pivoting end 26. The baseplate 14 is configured to be supported by a frame 12. The baseplate 14 is further configured to support a mattress 50. The mattress 50 defines a patient support surface 52 which includes a head section 82, a seat section 84, and a foot section 86. The mattress 50 further includes a moveable free end 54. The moveable top plate 18 is secured to the accordion sleeve 48. The moveable top plate 18 is positionable to underlie the moveable free end 54 of the mattress 50. The moveable top plate 18 further includes a free end 20 and a pivoting end 22. The pivoting end 22 of the moveable top plate 18 is pivotally connected to the pivoting end 26 of the baseplate 14. The air source 28 is operable to selectively inflate the inflatable air bladder 16 located at the foot section 86 of the mattress 50 to move the moveable top plate 18 relative to the baseplate 14, thereby creating space 88 between the mattress 50 and the baseplate 14. The angle 90 of this space 88 may be physically limited or limited by software. In some embodiments, it may include a sensor 66 to measure the angle 90.

Figure 10:
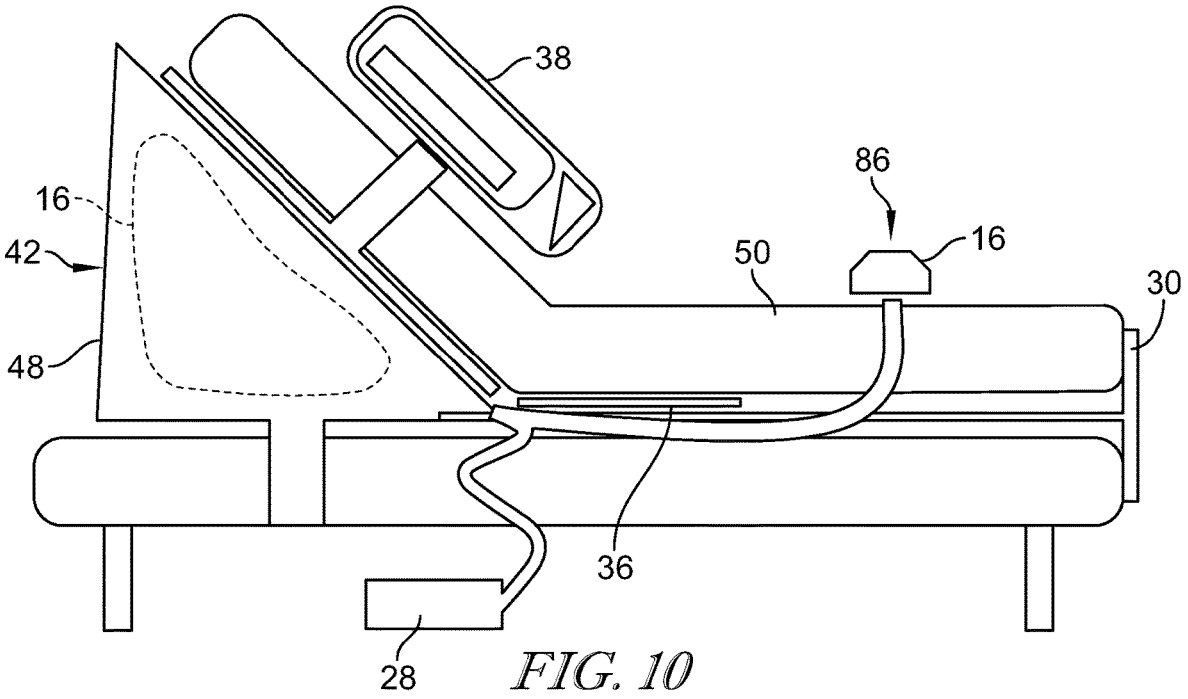
FIG. 10 is a diagrammatic representation of a bed assembly similar to the embodiment of FIG. 1 with the embodiment of FIG. 10 including an inflatable knee gatch bladder positioned on top of the mattress.

As shown in FIG. 10, in another embodiment, the inflatable air bladder 16 positioned at the foot section 86 of the mattress 50 is secured on top of the mattress 50 by a strap 32. In some embodiments, the inflatable air bladder 16 is configured to inflate and create a bolster to form the gatched knee position. In another embodiment, the inflatable air bladder 16 positioned at the foot section 86 of the mattress 50 is configured to inflate and create a raised level of the mattress 50.

Figure 11:
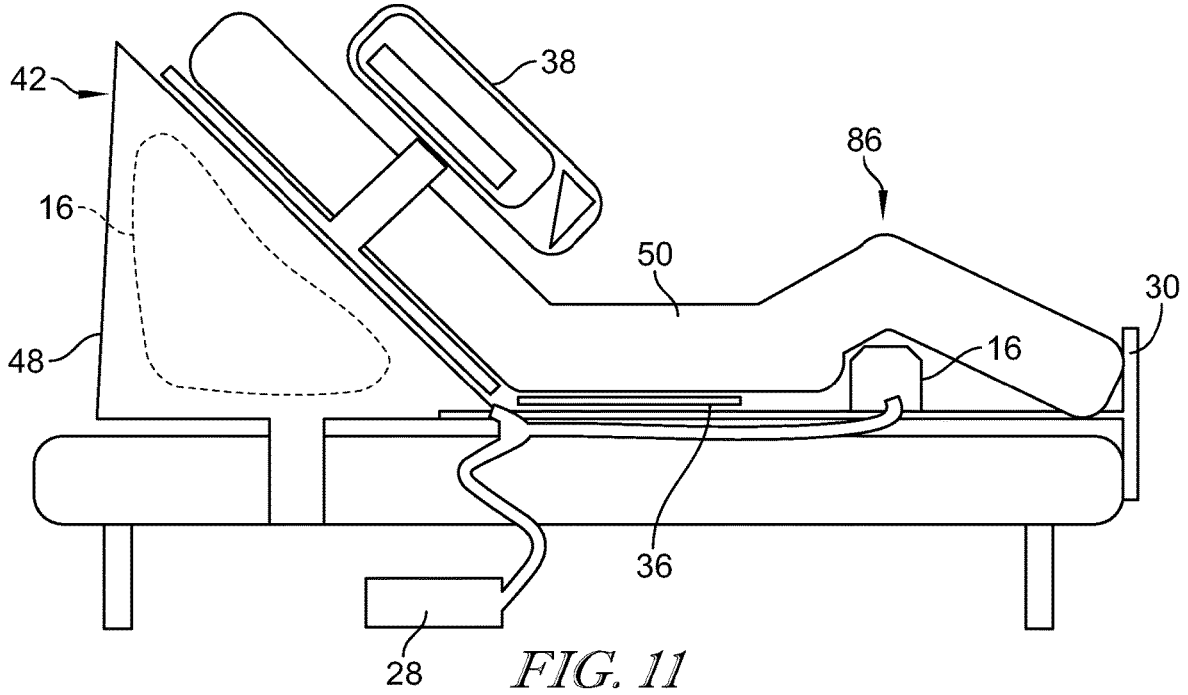
FIG. 11 is a diagrammatic representation of a bed assembly similar to the embodiment of FIG. 1 with the embodiment of FIG. 11 including an inflatable knee gatch bladder positioned below the mattress and operable to raise a portion of the mattress.

Referring to FIG. 11, the inflatable air bladder 16 positioned at the foot section 86 of the mattress 50 is secured under the mattress 50 by a strap 32. The inflatable air bladder 16 is configured to inflate and create a bolster to form the gatched knee position. In another embodiment, the inflatable air bladder 16 positioned at the foot section 86 of the mattress 50 is configured to inflate and create a raised level of the mattress 50.

Furthermore, as shown in FIG. 8, the vertical position of the support of the inflatable air bladder 16 may be adjusted along the length of the mattress 50 in relation to the height of the occupant. In some embodiments, the strap 32 attached to the inflatable air bladder 16 and secured to the retainer 30 further includes a set of pre-defined connection points based on the occupant's height. In another embodiment, the inflatable air bladder 16 positioned at the foot section 86 of the mattress 50 is tethered to the inflatable air bladder 16 positioned at the head section 82 of the mattress 50 so that when the inflatable air bladder 16 at the foot section 86 of the mattress 50 is pulled down the length of the mattress 50, the tether indicates the correct position of the inflatable air bladder 16 positioned at the foot section 86 of the mattress 50 based on the occupant's height.

Referring again to FIG. 6, the bed assembly 10 is configured to include a sensor 66 within the controller 60 and in communication with the inflatable air bladder 16 positioned at the foot section 86 of the mattress 50. The inflatable air bladder 16 positioned at the foot section 86 of the mattress 50 can be automatically inflated or deflated based on predetermined parameters once the sensor 66 exceeds a predetermined threshold.

As shown in FIGS. 1, 2, and 8, a contactless sensing system 36 may be secured under the mattress 50. In other embodiments, the contactless sensing system 36 is integrated with the frame 12. In other embodiments, the contactless sensing system 36 is integrated with the collapsible siderail 38. The contactless sensing system 36 is configured to gather data based on an occupant's motion, weight, and movement. In other embodiments, different methods of data gathering are integrated with the collapsible siderail 38, such as visual monitoring, traditional monitoring, and monitoring via wirelessly integrated wearable sensing devices. The collapsible siderail 38 may also be configured to provide point-of-care monitoring.

Looking to FIG. 7, the contactless sensing system 36 further includes sensors 70, a sensor control system 72, a controller 60, and a connectivity hub 74. The sensors 70 include a first sensor 100, a second sensor 102, a third sensor 104, and a fourth sensor 106. The sensors 70 are configured to measure at least one of the possible sensed parameters. The sensors 70 are positionable within the contactless sending system 36 and the individual sensors 100, 102, 104, 106 are configured to be placed in any arrangement within the contactless sensing system 36. Any arrangement of the individual sensors 100, 102, 104, 106 includes the omission of an individual sensor 100, 102, 104, 106 and the inactivation of an individual sensor 100, 102, 104, 106. Each individual sensor 100, 102, 104, 106 is configured to measure at least one of the possible sensed parameters, and multiple individual sensors 100, 102, 104, 106 may measure the same sensed parameter. Possible sensed parameters include heat rate, respiratory rate, temperature, blood pressure, oxygen saturation, heart rhythm, weight, sleep, sleep disordered breathing, information derived from occupant motion and activity, and incontinence.

As illustrated in the embodiment shown in FIG. 7, the first sensor 100 is configured to measure heart rate, the second sensor 102 is configured to measure sleep disordered breathing, the third sensor 104 is configured to measure incontinence, and the fourth sensor 106 is configured to measure oxygen saturation. Respectively, the first alert switch 108 is configured to alert the caretaker of a heart rate exceeding or dropping below the predetermined threshold, the second alert switch 110 is configured to alert the caretaker of an sleep disorder event, the third alert switch 112 is configured to alert the caretaker of an incontinence event, and the fourth alert 114 is configured to alert the caretaker of an oxygen saturation level exceeding or dropping below the predetermined threshold.

The sensors 70 are in communication with the controller 60. The controller 60 is within the sensor control system 72 and in communication with the connectivity hub 74 which is also within the sensor control system 72. The connectivity hub 74 is in communication with a remote computer device 76. The remote computer device 76 further includes an alert management interface 78. The alert management interface 78 further includes alert switches 80 configured to allow the caregiver to switch the alert on or off. The alert switches 80 include a first alert switch 108, a second alert switch 110, a third alert switch 112, and a fourth alert switch 114. The alert switches 80 are configured to alert a caregiver once a sensor 100, 102, 104, 106 exceeds a predetermined threshold based on predetermined parameters programed into the contactless sensing system 36. Each individual alert switch 108, 110, 112, 114 is configured to respond to an individual sensor 100, 102, 104, or 106.

Due to the contactless sensing system 36 having multiple methods for measuring the same vital sign, the source of the displayed or recorded vital sign may use one or more methods. This is calculated based on an algorithm to maximize accuracy and coverage.

Figure 9A:
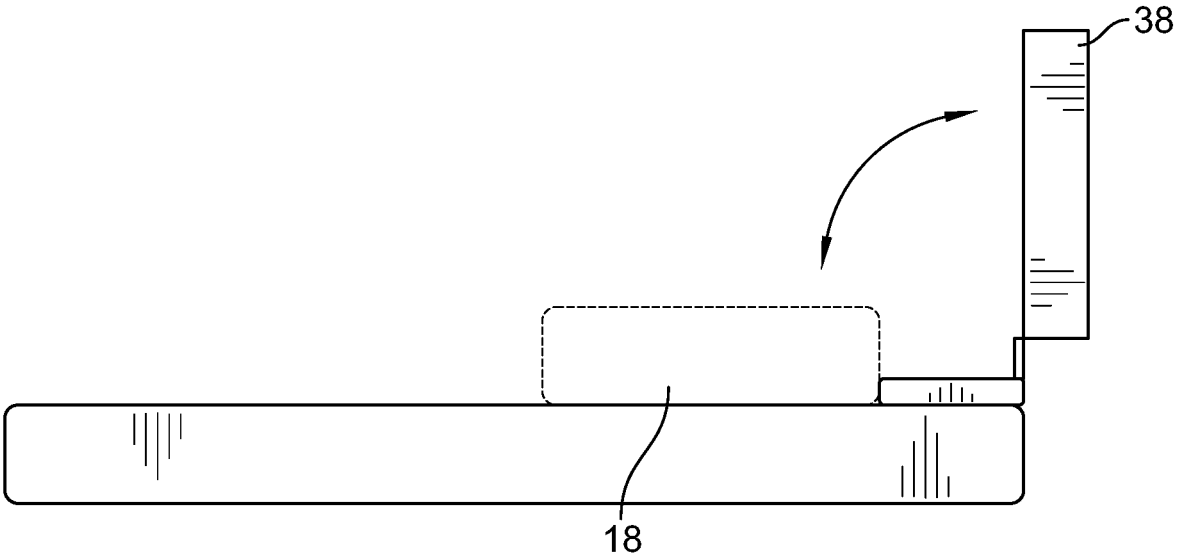
FIG. 9A is a diagrammatic representation of the packaging components of the bed assembly of FIG. 1 including an elevation assembly positioned at a foot end of the bed along with a retainer.
Figure 9B:
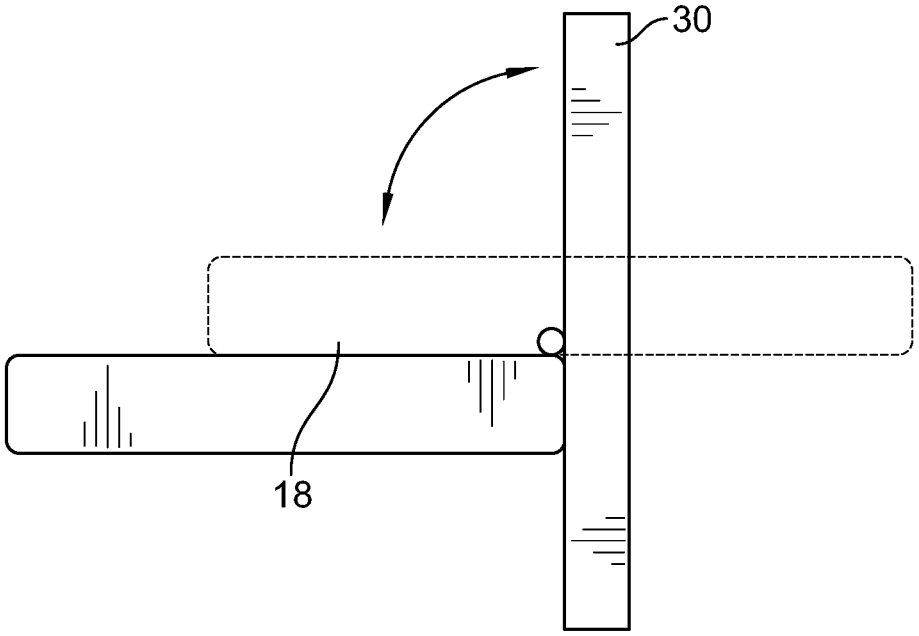
FIG. 9B is a diagrammatic representation of the packaging components of the bed assembly of FIG. 1 including an elevation assembly at the head end of the bed with a siderail.

Referring to FIG. 9, the collapsible siderail 38 and the retainer 30 are configured to fold flat. When folded, the collapsible siderail 38 moves from being in a perpendicular relationship with the moveable top plate 18 to a parallel relationship with the moveable top plate 18. The collapsible siderail 38 is pivotally secured to the moveable top plate 18 and is configured so that the caregiver may pack the bed assembly 10 into a moveable container and transfer the bed assembly 10 to a different location. The retainer 30 is also configured to be folded in order to aid in the packing and transfer of the bed assembly 10. The retainer 30 is configured to move from a perpendicular relationship with the moveable top plate 18 to a parallel relationship with the moveable top plate 18. After being folded, the bed assembly 10 may be shipped.

Although this disclosure refers to specific embodiments, it will be understood by those skilled in the art that various changes in form and detail may be made without departing from the subject matter set forth in the accompanying claims.

What is claimed is:

1. A bed assembly for elevating an occupant's head comprising a frame, a first baseplate configured to be supported by the frame, wherein the first baseplate has a free end and a pivoting end, a mattress configured to be supported by the first baseplate, wherein the mattress has at least one moveable free end, a first accordion sleeve, a first inflatable air bladder within the first accordion sleeve and positioned on the first baseplate;

a first moveable top plate secured to the first accordion sleeve and positionable to underlie the at least one moveable free end of the mattress, the first moveable top plate having a free end and a pivoting end, the pivoting end of the first moveable top plate pivotally connected to the pivoting end of the first baseplate, an air source in fluid communication with the first inflatable air bladder and operable to selectively inflate the first inflatable air bladder to move the first moveable top plate relative to the first baseplate and, thereby, create space between the mattress and the first baseplate and raise the free end of the mattress, a retainer secured to the first baseplate and extending along a foot end of the frame and configured to engage with the mattress to thereby prevent longitudinal movement of the mattress relative to the frame, and a first strap secured to the first inflatable air bladder and the retainer to prevent longitudinal movement of the first inflatable air bladder relative to the frame, wherein the first strap is adjustable to adjust a longitudinal position of the first inflatable air bladder relative to the frame to allow adjustment of the distance between the first inflatable bladder and the retainer based on an occupant's height.

2. A bed assembly according to claim 1, further comprising at least one strap secured to the first inflatable bladder, wherein the at least one second strap is configured to engage with the frame to thereby prevent movement of the mattress relative to the bed assembly.

3. A bed assembly according to claim 1, further comprising a collapsible siderail pivotally secured to the moveable top plate.

4. A bed assembly according to claim 3, further comprising a telemedicine screen pivotally secured to the collapsible siderail.

5. A bed assembly according to claim 4, wherein the collapsible siderail further comprises a control system, an audio or communication system, an integrated point-of care monitoring system, or a wireless hub.

6. A bed assembly according to claim 5, wherein the collapsible siderail is further configured to emit light.

7. A bed assembly according to claim 1, further comprising a second inflatable air bladder configured to be secured to the mattress and in fluid communication with the air source.

8. A bed assembly according to claim 7, further comprising a second baseplate, wherein the second baseplate has a free end and a pivoting end and the second inflatable air bladder is positioned on the second baseplate, a second accordion sleeve, wherein the second accordion sleeve encompasses the second inflatable air bladder, and a second moveable top plate secured to the second accordion sleeve and positionable to underlie the mattress, the second moveable top plate having a free end and a pivoting end, the pivoting end of the second moveable top plate pivotally connected to the pivoting end of the second baseplate.

9. A bed assembly according to claim 8, wherein a second strap is secured to the second inflatable air bladder and the retainer, wherein the retainer is secured to the second baseplate.

10. A bed assembly according to claim 9, wherein the second strap further comprises a set of pre-defined connection points allowing adjustment of the distance between the second inflatable bladder and the retainer based on an occupant's height.

11. A bed assembly according to claim 8, wherein the second inflatable air bladder is configured to be tethered to the first inflatable air bladder for at least indicating correct positioning based on the occupant's height.

12. A bed assembly according to claim 1, further comprising a contactless sensing system, wherein the contactless sensing system is secured under the mattress.

13. A bed assembly according to claim 1, further comprising an accelerometer in the first inflatable bladder.

14. A device for elevating an occupant's head in a bed comprising a first baseplate configured to be supported by a portion of the bed, wherein the first baseplate has a free end and a pivoting end, a first inflatable air bladder supported on the baseplate;

a first moveable top plate positioned over the first inflatable bladder and positionable to underlie a moveable free end of a mattress to support a portion of the mattress, the first moveable top plate having a free end and a pivoting end, the pivoting end of the first moveable top plate pivotally connected to the pivoting end of the first baseplate, an air source in fluid communication with the first inflatable air bladder and operable to selectively inflate the first inflatable air bladder to move the first moveable top plate relative to the first baseplate and, thereby, create space between the mattress and the first baseplate, a retainer secured to the first baseplate and extending along a foot end of the bed and configured to engage with the mattress to thereby prevent longitudinal movement of the mattress relative to the bed, and a first strap secured to the first inflatable air bladder and the retainer to prevent longitudinal movement of the first inflatable air bladder relative to the bed, wherein the first strap is adjustable to adjust a longitudinal position of the first inflatable air bladder relative to the bed to allow adjustment of the distance between the first inflatable bladder and the retainer based on an occupant's height.

15. A device according to claim 14, further comprising at least one second strap secured to the first inflatable bladder, wherein the at least one second strap is configured to engage with the portion of the bed supporting the base plate to thereby prevent movement of the mattress relative to the bed assembly.

16. A device according to claim 15, further comprising a collapsible siderail pivotally secured to the moveable top plate.

17. A device according to claim 16, further comprising a telemedicine screen pivotally secured to the collapsible siderail.

18. A device according to claim 16, wherein the collapsible siderail further comprises a control system, an audio or communication system, an integrated point-of care monitoring system, or a wireless hub.

19. A device according to claim 14, further comprising a second inflatable air bladder configured to support a portion of a mattress of the bed and in fluid communication with the air source.

20. A device according to claim 19, further comprising a second baseplate, wherein the second baseplate has a free end and a pivoting end and the second inflatable air bladder is positioned on the second baseplate, and a second moveable top plate positionable to underlie the mattress, the second moveable top plate having a free end and a pivoting end, the pivoting end of the second moveable top plate pivotally connected to the pivoting end of the second baseplate.

21. A device according to claim 20, wherein a second strap is secured to the second inflatable air bladder and the retainer, wherein the retainer is secured to the second baseplate and configured to engage with the mattress to thereby prevent movement of the mattress relative to the remainder of the bed.

* * * * *